US005398054A

United States Patent [19]

Fukazawa et al.

[11] Patent Number: 5,398,054

[45] Date of Patent: Mar. 14, 1995

[54] INK JET APPARATUS

[75] Inventors: Hideo Fukazawa, Yokohama; Koji Terasawa, Mitaka; Atsushi Arai, Kawasaki; Koichiro Kawaguchi, Yokohama, all of Japan

[73] Assignee: Canon Kabushiki Kaisha, Tokyo, Japan

[21] Appl. No.: 831,513

[22] Filed: Feb. 5, 1992

[30] Foreign Application Priority Data

Feb. 6, 1991 [JP] Japan ..... 3-036856

[51] Int. Cl.[6] ..... B41J 2/165

[52] U.S. Cl. ..... 347/33; 347/23; 347/32

[58] Field of Search ..... 346/140 R, 1.1; 347/30, 347/32, 33, 22, 23, 29; 15/250.36

[56] References Cited

U.S. PATENT DOCUMENTS

| | | | |
|---|---|---|---|
| 4,045,802 | 8/1977 | Fukawawa et al. | 346/140 R |
| 4,112,435 | 9/1978 | Kattner et al. | 346/140 R |
| 4,306,245 | 12/1981 | Kasugayama et al. | 346/140 R |
| 4,313,124 | 1/1982 | Hara | 346/140 R |
| 4,345,262 | 8/1982 | Shirato et al. | 346/140 R |
| 4,364,065 | 12/1982 | Yamamori et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,600,931 | 7/1986 | Terasawa | 346/140 R |
| 4,723,129 | 2/1988 | Endo et al. | 346/1.1 |
| 4,740,796 | 4/1988 | Endo et al. | 346/1.1 |
| 4,745,414 | 5/1988 | Okamura et al. | 347/30 |
| 4,855,764 | 8/1989 | Humbs et al. | 347/33 |
| 4,935,753 | 6/1990 | Lehmann et al. | 346/140 R |
| 4,951,066 | 8/1990 | Terasawa et al. | 346/140 R |
| 4,959,673 | 9/1990 | Noda | 346/140 R |
| 5,065,158 | 11/1991 | Nojima et al. | 346/140 R |
| 5,126,765 | 6/1992 | Nakamura | 346/140 R |
| 5,182,582 | 1/1993 | Okamura | 346/140 R |
| 5,202,702 | 4/1993 | Terasawa et al. | 347/33 |
| 5,266,974 | 11/1993 | Koitabashi et al. | 347/33 |

FOREIGN PATENT DOCUMENTS

| | | |
|---|---|---|
| 3736916 | 5/1988 | Germany . |
| 54-056847 | 5/1979 | Japan . |
| 58-094472 | 6/1983 | Japan . |
| 59-123670 | 7/1984 | Japan . |
| 59-138461 | 8/1984 | Japan . |
| 60-071260 | 4/1985 | Japan . |

*Primary Examiner*—A. T. Grimley
*Assistant Examiner*—T. A. Dang
*Attorney, Agent, or Firm*—Fitzpatrick, Cella, Harper & Scinto

[57] ABSTRACT

In an ink jet recording apparatus for performing recording by discharging ink from a recorder a recording medium, there is provided a rubbing member which is caused to be slidably in contact with the discharging port surface of the recorder for each of the predetermined operations in order to remove ink droplets, water droplets, dust, and other impurities as well as ink films created by the adhering ink, which cause defective ink discharging, hence enabling a more reliable cleaning operation to attain a higher printing quality.

13 Claims, 11 Drawing Sheets

INK JET APPARATUS

BACKGROUND OF THE INVENTION

1. Field of the Invention

The present invention relates to an ink jet recording apparatus for performing recording by discharging ink from recording means to a recording medium.

2. Related Background Art

A recording apparatus such as a printer used as an output apparatus for a computer or, word processor, copying machine, or a facsimile apparatus is structured to record images by recording means on a recording sheet, thin plastic sheet, or other recording media in accordance with the image information. The aforesaid recording apparatuses are divided into those of an ink jet type, wire dot type, thermal type, laser beam type, and some others by the method that each apparatus employs for its recording.

Among these methods, the ink jet recording method (ink jet recording apparatus) is such that ink is caused to be discharged from recording means (recording head) onto a recording medium to perform a desired recording with the impacted ink dots thereon. Since the diameter of the ink dot discharged can be made extremely small, it is possible to record superfine images on an ordinary sheet at high speeds without any particular treatment. In addition, this is a non-impact method and there is less noise. With this method, there is an advantage that it is easy to record color images using a plurality of color inks. Particularly, the recording means (recording head) which utilizes thermal energy for discharging ink among those ink jet methods can be manufactured by the use of the semiconductor fabrication process such as etching, vapor deposition, sputtering, and the discharging ports required for discharging ink with a high density and the conductive ink passes connected thereto can be fabricated with ease.

However, as the discharging ports are arranged in such a high density, disabled ink discharging, deviation in the ink discharging orientations, or other discharging defectives tend to occur if paper particles, dusts, overly viscous ink, or the like adheres to the vicinity of the discharging ports of the aforesaid recording means or there are generated ink puddles or the like in the vicinity of the ink discharging ports. This results in degrading the image quality. Therefore, in the ink jet apparatus, there have been designed countermeasures such as means for removing various foreign matters adhering to the vicinity of the discharging ports which bring about inferior image quality.

For example, as means for preventing the clogging of the discharging ports due to the increased viscousity of ink resulting from the evaporation of the ink solvent or the adhesion of dust or the generation of bubbles, there have been proposed structures such as disclosed in U.S. Pat. No. 4,045,802 and U.S. Pat. No. 4,600,931 in which the discharging port formation surface of the recording head is covered by a cap when no recording is performed to protect the surface from being exposed to the atmosphere for the prevention of the dust adhesion as well as of the evaporation of the ink solvent, so that the discharging ports are maintained in a desirable condition, or a discharging recovery device is arranged to forcibly exhaust ink from the discharging ports together with the overly viscous ink, dust, bubbles, or the like in the discharging ports simultaneously by the use of a suction pump.

Also, there is a structure (hereinafter referred to as prior art 1) whereby dust and overly viscous ink in the vicinity of the discharging ports is removed by wiping the front face (discharging port formation surface) of the recording head by a plastic blade made of rubber and others as disclosed in U.S. Pat. No. 4,112,435, U.S. Pat. No. 4,364,065 or Japanese Patent Laid-Open Application 58-94472. Further, there is, for example, another structure (hereinafter referred to as prior art 2) that slides a brush and ink absorbent member in the circumference of the discharging ports in order to obtain the same effect as in the prior art 1 as disclosed in U.S. Pat. No. 4,306,245.

Nevertheless, after many experiments conducted by the inventor et al hereof, it has been discovered that in some cases the ink discharging defects cannot be recovered sufficiently by the techniques according to the prior arts 1 and 2 described above, and that there is still need for improvement.

In other words, in the case of the prior art 1, it is possible to remove the droplets having a comparatively low viscosity such as the ink droplets which have adhered to the circumference of the discharging ports or the dew condensation on the circumference of the discharging ports due to the increased humidity in the apparatus by the discharging recovery operation by suction and the like. However, when recording is resumed after a reset or suspension after a long period of time, it is noticed that the images are disturbed due to the ink droplets which do not adhere to the accurate positions on the surface of the recording sheet because, although there is no disabled ink discharging by the use of the discharging recovery device, it is still difficult to eliminate the deviation of the flying directions of the ink droplets.

Also, in the case of the prior art 2, the required cleaning is repeatedly operated at a home position, which in some cases brings about the surface staining or scuffing due to the durability of the ink absorbent, and it may result in the defective ink discharging because of the adhesion of foreign matters to the circumference of the discharging ports in spite of the intended cleaning.

Under the circumstances, the inventor et al hereof have conducted various trial recordings thoroughly as further experiments while carefully observing the circumference of the discharging ports in order to find out the causes for the generation of the ink discharging defects. As a result, it is found that the defects occur due to the changes in the state of ink adhering to the circumference of the discharging ports OF as shown in FIGS. 2A through 2D which illustrate the states of the discharging port surface of the recording head. In other words, as shown in FIGS. 2A and 2B, if the ink droplets ID adhere to the circumference of the discharging ports OF of the recording head 5 due to dew condensation or the like, these droplets are dried to create extremely thin ink films Id which are fixed to the circumference of the discharging ports OF as shown in FIG. 2C and FIG. 2D. Many of the ink films Id such as those shown here have been created when the performance of the recording is suspended for a long period of time.

Although it has been known that defective discharging results when recording is resumed after a long period of recording suspension, the increased viscosity of ink or air mixture is considered to be its cause. It was through that the clogging caused by the increased viscosity of ink and air mixture are the major causes for the defective discharging, but it has not been known that the deviation of the ink discharging orientation is caused by the above-mentioned ink film Id. Moreover, these ink films Id cause the ink repellency of the discharging port surface to be lowered thus creating the state where the ink droplets easily adhere thereto.

Taking these facts into account, the present inventor et al hereof have repeated many experiments and discussions on the structure of an ink jet recording apparatus capable of obtaining desirable recording images by removing the causes of the defective dischargings most effectively. As a result, it is also found that as means for cleaning the discharging port surface of an ink jet recording apparatus, it is still preferable to remove the ink droplets, ink puddles, and dew condensations on the vicinity of the discharging ports by the use of the aforesaid plastic blade in consideration of the wiping effect and durability.

However, when the ink droplets or ink puddles adhere for a long period of time and are dried to form the extremely thin films on the circumference of the discharging ports in a fixed state, the discharging orientations become unstable due to these ink films although there appear to be no ink puddles. In addition, the ink repellency of the discharging port surface is lowered so that the ink puddles tend to be created thereon. Accordingly, the spiral dischargings tend to occur. It is impossible to remove such an ink film as this sufficiently with the cleaning conducted by the aforesaid blade.

As a result of the ardent research and repeated experiments by the present inventor et al hereof for the purpose of improving the aforesaid technical problems, it has been recognized that the adhesive foreign matters can be removed desirably by a slidably rubbing member other than the blade which is slidably in contact with the discharging port surface with a predetermined timing. Particularly, a constant relationship between the adhesive conditions of the foreign matters and the heat temperatures and image formation column numbers should be found, and by performing the contact sliding with a predetermined timing which is selected by both of them, it is possible to effectuate a desirable cleaning of the discharging ports.

SUMMARY OF THE INVENTION

In consideration of the above-mentioned technical problems, the present invention is designed, and it is an object thereof to provide an ink jet recording apparatus capable of removing the ink films created by ink adhesion and of removing the ink droplets, water droplets, dusts, and other impurities adhering to the vicinity of the discharging ports simultaneously as well as of preventing in advance the strength needed for peeling the ink films which results in the defective discharging from becoming great, and further, of implementing the stabilization of ink discharging without any particular attention given by the user.

In an ink jet recording apparatus having a plurality of recording means, it is another object of the present invention to provide an ink jet recording apparatus capable of removing for each of particular recording means the films created by the ink droplets and water droplets adhering to the vicinity of the discharging ports, and of preventing in advance for each of the particular recording means the strength needed for peeling the ink films which results in the defective discharging from becoming great as well as of implementing the stabilization of discharging for each of the recording means without any particular attention given by the user, and further, of preventing the increasing frequency of the rubbing operations which are otherwise inevitably generated due to the plurality of the recording means.

Also, in an ink jet recording apparatus for performing recording by discharging ink from recording means onto a recording medium, it is still another object of the present invention to provide an ink jet apparatus which is structured to arrange a rubbing member being slidably in contact with the discharging port surface when each of the predetermined operations is performed.

Also, in an ink jet recording apparatus for performing recording by discharging ink from a plurality of recording means onto a recording medium, it is a further object of the present invention to provide an ink jet apparatus which is structured to arrange a rubbing member being in contact with the discharging port surface of a specific recording means.

DETAILED DESCRIPTION OF THE PREFERRED EMBODIMENTS

Hereinafter, in reference to the accompanying drawings, the embodiments according to the present invention will be described.

Figure 1A:
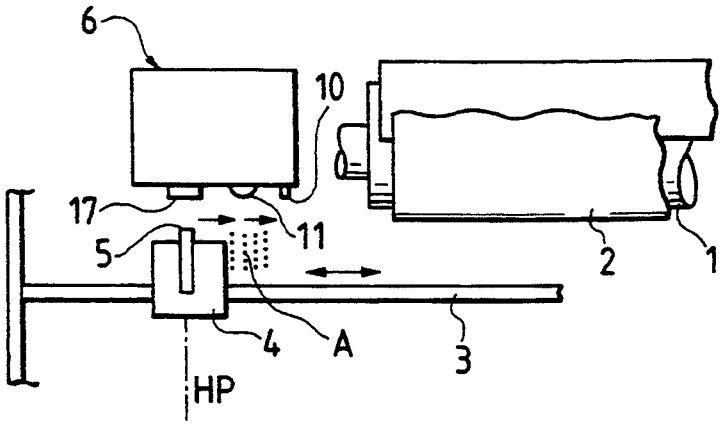
FIGS. 1A to 1C show a partially plane view schematically illustrating the structure of the principal part of an embodiment of an ink jet recording apparatus according to the present invention, a partially enlarged perspective view illustrating the clearing operation of the resilient blade provided for the aforesaid recording apparatus, and a partially enlarged perspective view illustrating the cleaning operation of the rubbing member provided for the aforesaid recording apparatus.
Figure 1B:
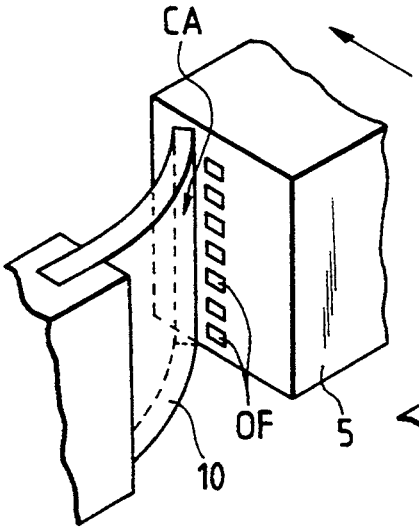
Figure 1C:
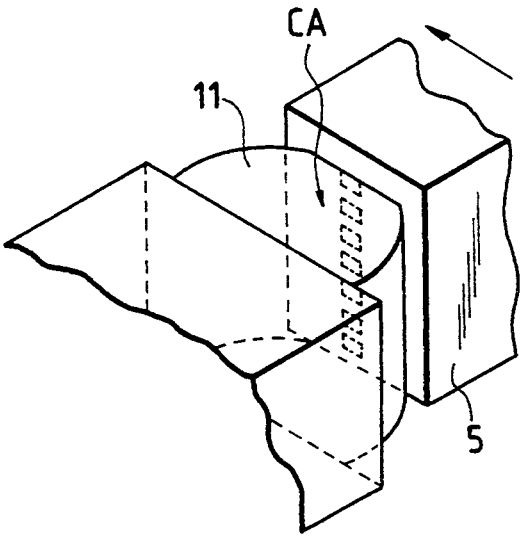
Figure 2A:
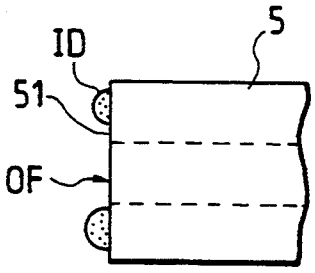
FIGS. 2A to 2D show a side view and front view illustrating the states of the discharging port surface of an ink jet recording apparatus where ink droplets adhere thereto and the adhering ink droplets are dried and changed into the ink films.
Figure 2B:
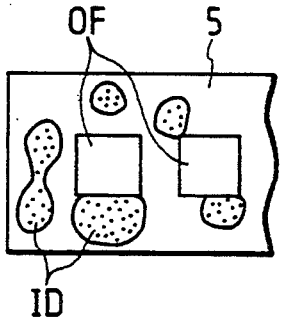
Figure 2C:
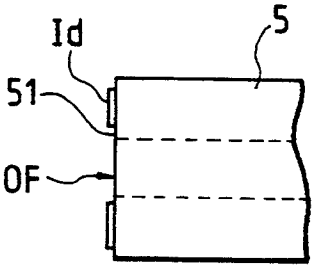
Figure 2D:
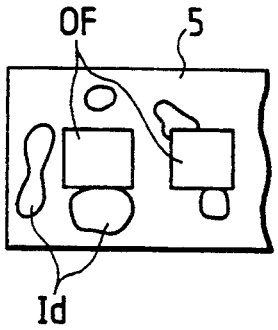

FIGS. 1A, 1B, and 1C are views schematically illustrating the structure of the principal part of an ink jet recording apparatus according to the present invention. FIG. 1A is a plan view partially illustrating the circumference of a discharging recovery device of an ink jet recording apparatus. FIG. 1B is a perspective view illustrating the state of wiping by a resilient blade 10 shown in FIG. 1A. FIG. 1C is a perspective view illustrating the state that a rubbing member 11 shown in FIG. 1A is slidably in contact with a recording head.

In FIG. 1A, there is provided a guide shaft 3 in front of a recording medium 2 such as a recording sheet or plastic thin sheet which is supported by a platen 1. A recording means (recording head) 5 is mounted on the carriage 4 which travels along the aforesaid guide shaft 3. For this recording means b, it may be possible to adopt the recording means of the so-called permanent type in which ink is supplied from a separate ink tank through a conductive means such as a tube, or of a cartridge type with an ink tank integrally provided therewith, or of a line type having a length to cover partially or totally the entire area in the width direction of a recording medium 2.

The aforesaid recording means ( recording head ) 5 is provided with an electrothermal converting member which generates thermal energy. Also, the aforesaid recording means 5 discharges ink from the aforesaid discharging ports in response to the change of state of ink by the film boiling including bubble generation which is created in the ink by the thermal energy generated by the aforesaid electrothermal converting member.

Figure 3:
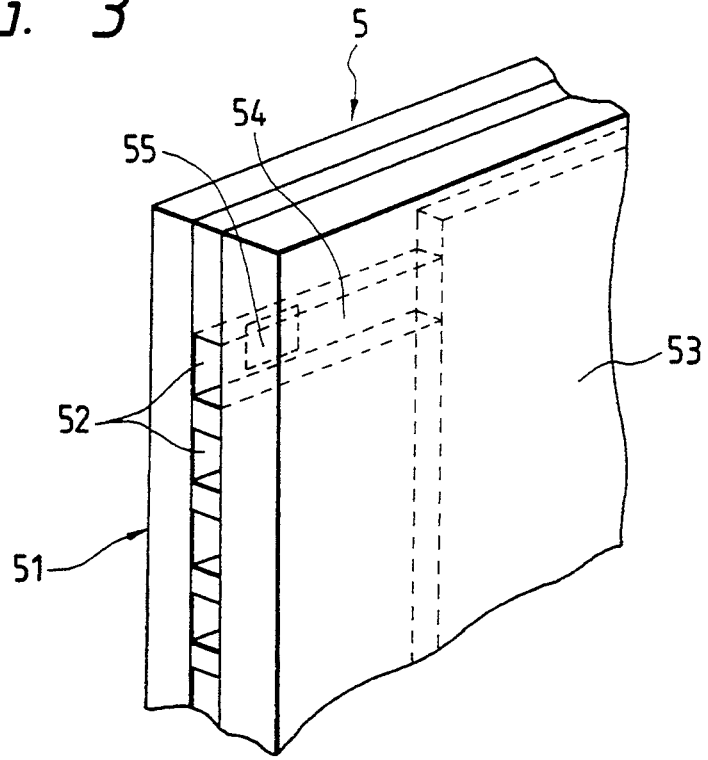
FIG. 3 is a partially perspective view schematically illustrating the structure of the ink discharging ports of the recording means which is shown in FIG. 1A to 1C.

FIG. 3 is a partially perspective view schematically illustrating the structure of the discharging port unit of the aforesaid recording means (recording head) 5. In FIG. 3, a plurality of discharging ports 52 are formed at predetermined pitches on the discharging port surface 51 which faces the aforesaid recording medium 2 with a space (of, for example, approximately 0.5 to 1.5 mm ) therebetween, and on each wall of the conductive passes 54 which connect a common liquid chamber 53 and each of the discharging ports 52, the electrothermal converting member (exothermic resistor and others) 55 is arranged for generating energy required for discharging ink. In the ink jet recording apparatus shown in FIG. 1, the recording means (recording head) 5 is mounted on the aforesaid carriage 4 in such a positional relationship that the aforesaid plurality of discharging ports 52 are arranged in the direction intersecting the main scanning direction (traveling direction) of the aforesaid carriage 4. Thus, in response to the image signals or discharging signals, the corresponding electrothermal converting member 55 is driven (energized) to boil the ink in the liquid pass 54. The recording means (recording head) 5 is structured to discharge ink from the respective discharging ports 52 by the pressure thus generated.

Figure 4:
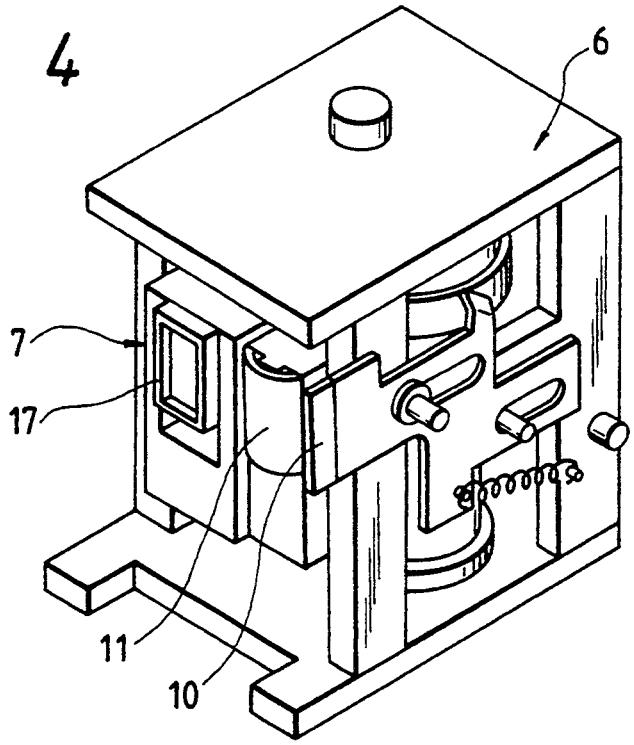
FIG. 4 is a perspective view illustrating the discharging recovery device shown in FIG. 1A to 1C.

In FIG. 2, the discharging port surface 51 of the aforesaid recording means 5 is provided with an ink repellent surface treatment, for example. Also, as shown in FIGS. 1A to 1C, at the home position HP of the carriage 4, the discharging recovery device 6 for the recording head 5 (in the example shown in FIG. 1, the device 6 being of a pump suction type) is arranged. FIG. 4 is a perspective view illustrating this discharging recovery device 6. In FIG. 1 through FIG. 4, the discharging recovery device 6 is arranged to be driven to advance toward or retract from the recording head 5 and is provided with a capping means 7 having a cap 17 capable of covering the discharging port surface 51 of the recording head 5 at the advanced position as well as with a pump 9 which causes the ink to be sucked from the discharging ports 52 of the recording head 5 through the aforesaid capping means 7. The operation of the discharging recovery device 6 is automatically performed. The operation may also be possible by the user through a manual switching provided.

In FIGS. 1A to 1C and FIG. 4, there is provided on the side portion of the discharging recovery device 6 the plastic blade 10 for wiping the vicinity of the discharging ports (usually, the discharging port surface) of the recording head 5. Also, on the side portion of the capping means 7, the rubbing member 11 is provided, which advances or retracts integrally with the aforesaid capping means 7. This rubbing member 11 is a member to rub the discharging port surface 51 in the vicinity of the discharging ports 52 of the recording head 5, and is structured to be slidably in contact with the discharging port surface 51 with its contacting area which is greater than the aforesaid resilient blade 10. In this respect, the "blade" in the present invention is the member which slides on the discharging port surface 51 substantially in a state of linear contact therewith, that is, as shown in FIG. 1B, the member which has a small contacting area CA. On the other hand, the "rubbing member" in the present invention is the member which is slidably in contact with the discharging port surface 51 with a large contacting area CA as shown in FIG. 1C.

Now, by controlling the travel of the carriage 4, the rubbing member 11 is allowed to advance together with the capping means 7 when the recording head 5 arrives at the position indicated by chain line A from the home position HP in FIG. 1A. Then, the aforesaid rubbing member 11 is caused to be in contact with the discharging port surface under pressure as shown in FIG. 1C. The structure is arranged so that the carriage 4 is further traveled in the direction toward the right-hand side in FIG. 1A for a predetermined distance to cause the aforesaid rubbing member to rub the discharging port surface 51. In other words, the system is constructed so as to utilize both the capping operation and carriage operation for the operation of the aforesaid rubbing member 11.

The rubbing member 11 serves to remove the adhering ink droplets ID and the fixed ink films Id by rubbing without damaging the discharging port surface 51 of the recording head 5, and is made of a porous material, fibrous tissue, or nonwoven fabric. Also, the rubbing operation of the aforesaid rubbing member 11 (pressurized contact sliding) is arranged to be performed for each of the predetermined operations of the recording apparatus. For the predetermined operations of the recording apparatus, there are selected a timing for preventing in advance the strength required for peeling the ink films Id which results in the defective discharging from becoming great, and a timing for implementing the stabilized ink discharging without any attention of the user. For example, the time for replacing ink tanks, the set hours controlled by a timer, the time for turning on the source power, or the like is selected.

Figure 5:
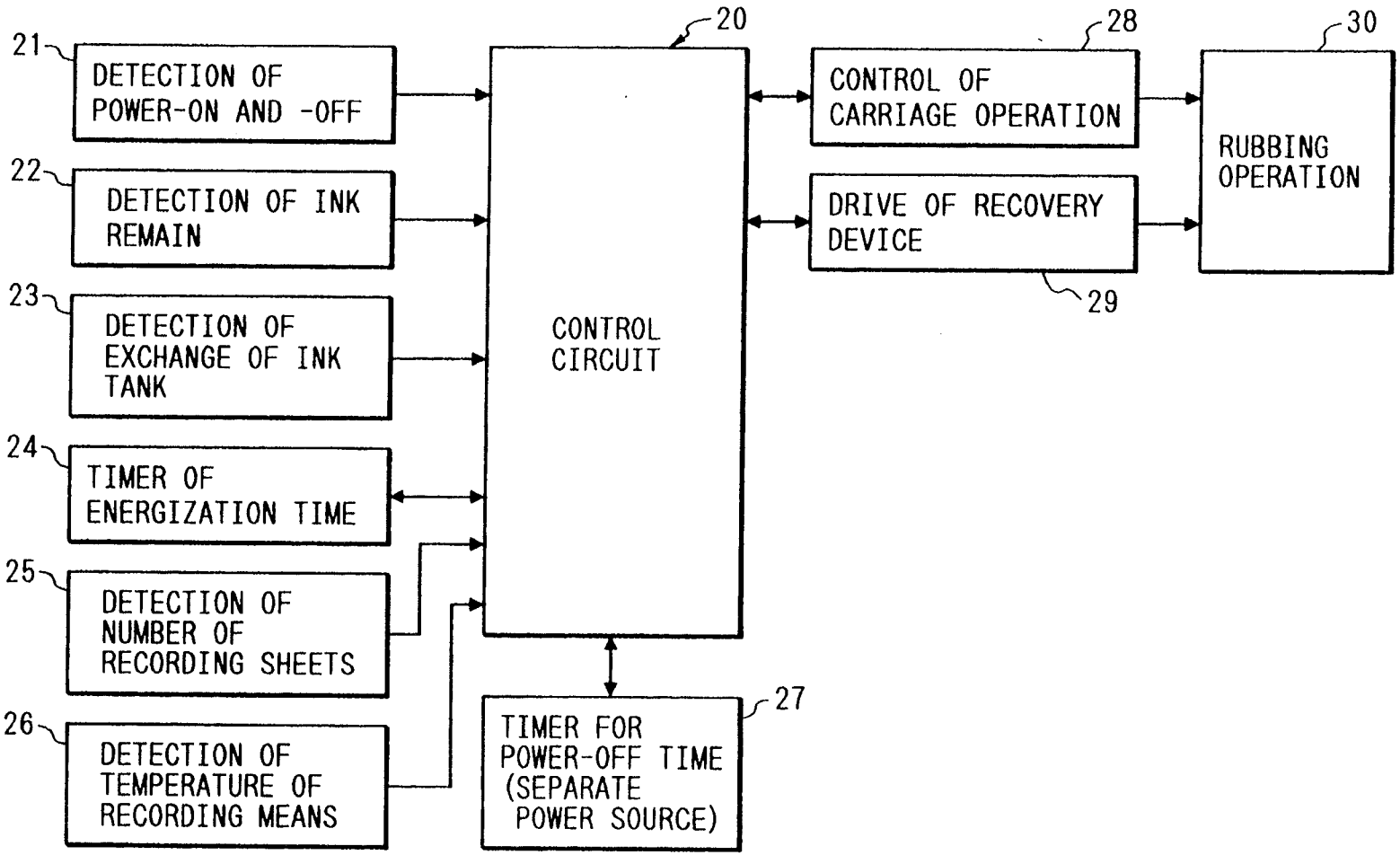
FIG. 5 is a block diagram showing the structure of the control system for the rubbing operation of an ink jet recording apparatus according to the present invention.

FIG. 5 is a block diagram showing the structure of the control system for the rubbing operation of an ink jet recording apparatus according to the present invention. In FIG. 5, there are inputted the control circuit 20 of the recording apparatus, the power source on-off signal from a power source on-off detection means 21, the remainder detection signal from a detection means 22 for detecting the remaining quantity of ink in the ink cartridge (ink tank), the ink cartridge detection signal from a detection means 23 for detecting the presence of the ink cartridge, the energizing time counting signal from a timer 24 for detecting the energizing period of time after the power source of the recording apparatus has been turned on, the recording sheet number counting signal from a detection means 25 for detecting the recording sheet number of a recording medium 2, the head temperature signal from a temperature detection means 26 for the recording means (recording head) 5, and the off time counting signal from a power off counting timer 27 for detecting the elapsed time after the power source of the recording apparatus has been turned off, respectively.

In this respect, the above-mentioned power source on-off detection is performed by the control circuit 20 which detects the rising of the voltage level when the power source is turned on and detects the dropping of the voltage level when the power source is turned off. Also, based on this, various timers can be set or reset. Further, the power off counting timer 27 serves to detect the elapsed time after the power is turned off, and is operated by a separate power source such as a lithium cell. In the meantime, the aforesaid control circuit 20 outputs control signals to a carriage motor driver 28 and recovery device driver 29 in accordance with each of the above-mentioned input signals so as to control the rubbing operation for the discharging port surface 51 by the rubbing means 30 (rubbing member 11), which is performed by the combined movements of the carriage 4 and the rubbing member 11 (interlocked with the capping means 7). With the control system structured as above, each of the sequences required for performing the cleaning operation by the rubbing member 11 appropriately is automatically selected, hence making possible the control to obtain stabilized ink dischargings easily and reliably at all times. Hereunder, each of the sequences for the aforesaid rubbing operation by the rubbing member 11 will be described.

Figure 6:
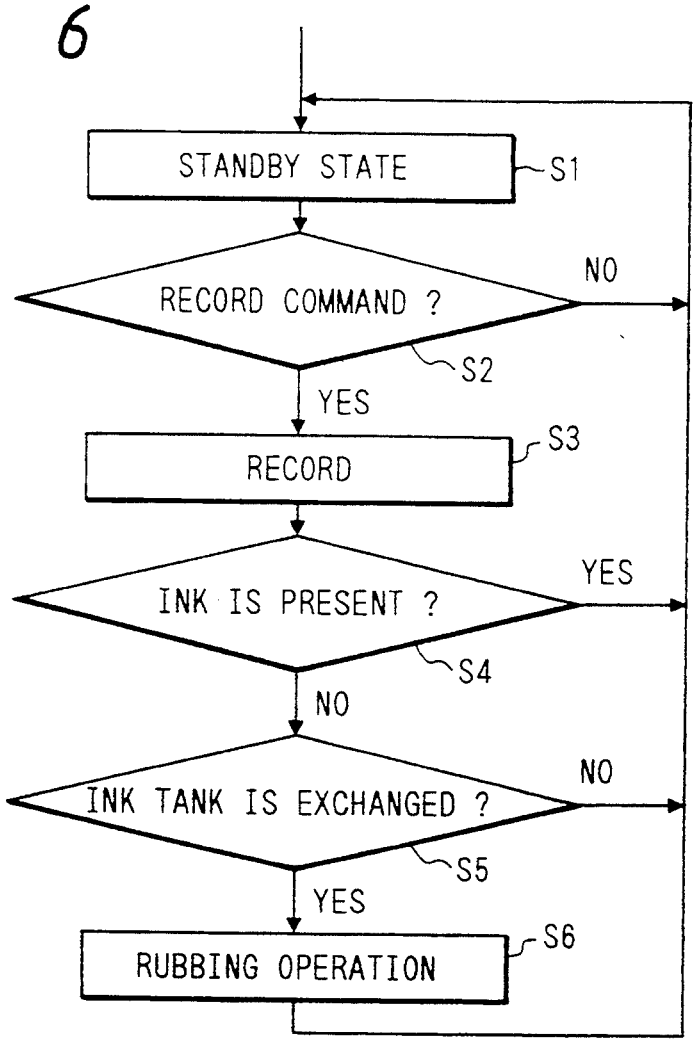
FIG. 6 is a flowchart showing the sequence of a first rubbing operation of an ink jet recording apparatus according to the present invention.

FIG. 6 is a flowchart showing the sequence required when the rubbing operation is performed at the time of replacing ink cartridges. In FIG. 6, the presence of a recording instruction is examined in proceeding to step S2 from step S1 where the system is in a standby state. If the instruction is present, the process proceeds to step S3 to execute the instructed recording, and examine the presence of ink on the basis of the ink remainder detection signal in step S4 after the completion of the recording. If, in step S2, there is no recording instruction or in the step S4, there is ink still present, the process will return to the step S1 to cause the system to be in the standby state. If, in the step S4, there is no presence of ink, the process proceeds to step S5 to examine whether ink cartridges have been replaced or not. When there is no replacement of the ink cartridges, the system remains in the standby state. If the ink cartridges are replaced, the process will proceed to step S6 to execute the aforesaid rubbing operation by the rubbing member 11 automatically in the vicinity of the discharging ports. According to this sequence, it is possible for the maintenance of the stabilized discharging to clean the vicinity of the discharging ports 52 in advance in response to the amount of ink consumed.

Figure 7:
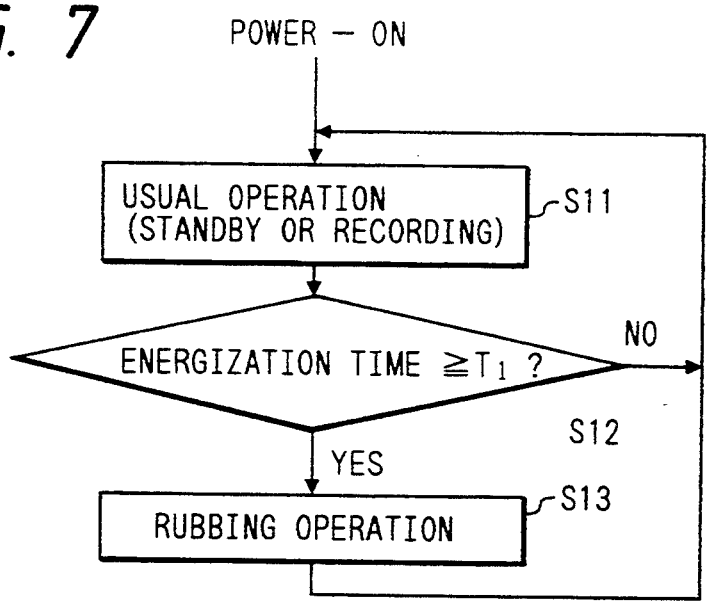
FIG. 7 is a flowchart showing the sequence of a second rubbing operation of an ink jet recording apparatus according to the present invention.

FIG. 7 is a flowchart showing the sequence required when the rubbing operation is performed in response to the elapsed time after the power source 10 has been turned on (energized) in such a case that the user operates the apparatus with the power source being kept on. In FIG. 7, whether the energizing time has passed a set value $T_1$ or not is determined in the step S12 to which the process proceeds from the step S11 where the recording with the power source-on is executed or from the usual standby state. If the energizing has passed the set time, the process proceeds to step S13 to perform the rubbing operation as has been described. Then, the process will return to the step S11 for executing the usual operation. On the other hand, if the energizing has not reached the set time, the process will return to the step S11 to execute the usual operation as it is. This sequence enables the rubbing member 11 to clean the vicinity of the discharging ports automatically when the energizing time (elapsed time after the power source having been turned on) has passed a set time, and is efficiently applicable when the user uses the recording apparatus with the power source being kept on.

Figure 8:
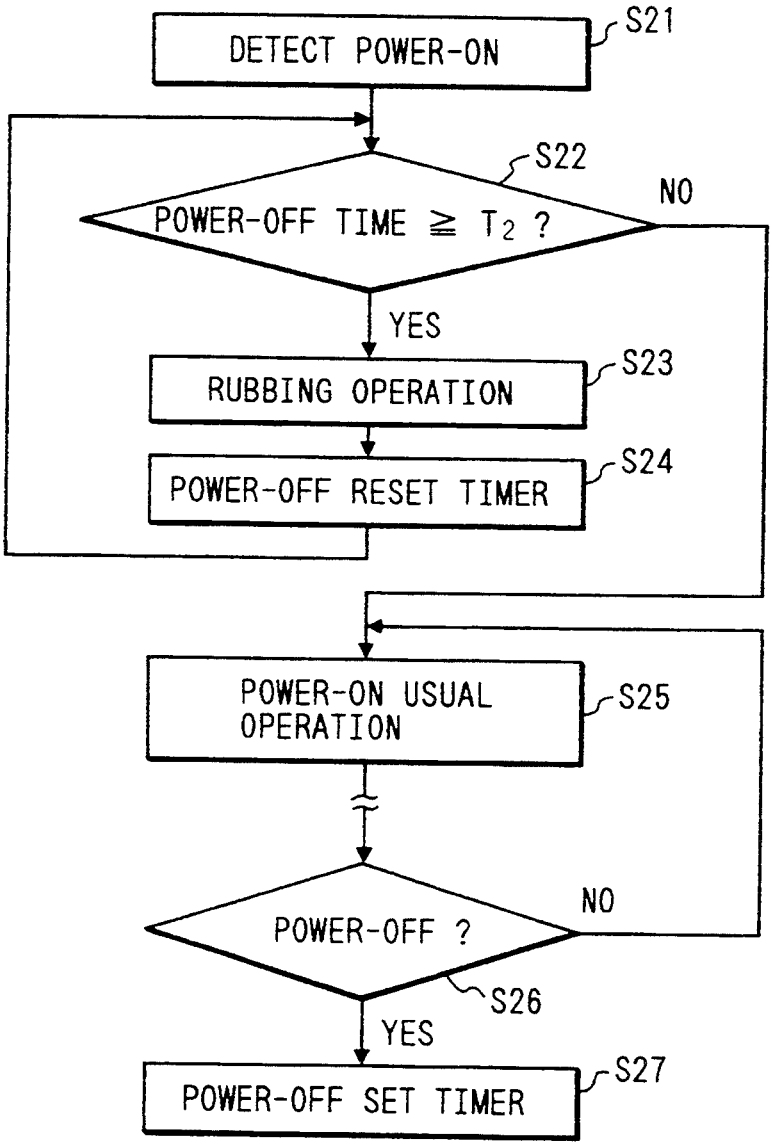
FIG. 8 is a flowchart showing the sequence of a third rubbing operation of an ink jet recording apparatus according to the present invention.

FIG. 8 is a flowchart showing the sequence when an elapsed time from the power-off to power-on is long. In FIG. 8, when the power-on is detected in step S21, the process proceeds to step S22 to judge whether the power-off time so far has passed a set time $T_2$ or not. This judgment is made on the basis of the counting value given by the power-off counting timer 27 (FIG. 5) which is operated by a separate power source such as a lithium cell. If the time has exceeded the set time, the rubbing operation in the vicinity of the discharging ports is executed in step S23. Then, in step S24, subsequent to having rest the power-off counting timer 27, the process will return to the step S22 to execute the usual recording or to cause the system to be in the standby state. On the other hand, if, in the step S22, the time is not found to have exceeded the set time, the process proceeds to step S25 to execute the usual recording at the time of power-on or to cause the system to be in the standby state. In step S26, whether the power is turned off or turned on is determined. If the power-off is detected, the power-off counting timer 27 is set in step S27 to prepare for the next power-on operation.

According to this sequence, no rubbing operation is unnecessarily even if the power-on operation is repeated, and the recording apparatus can be brought into the standby state immediately except when it is not in use for a long time. It is possible to control the system to perform the rubbing operation automatically only after the recording apparatus has not been in use for a long time. Therefore, the rubbing operation can be performed efficiently and at the same time, the durability of the cleaning mechanism can be improved. For example, it may be possible to make an arrangement in such a way that while the recording apparatus is left in the power-on state, the rubbing operation is set to be executed when a recording is started after one day, or it is set to be executed automatically after three days while it is left in the power-on state.

By the ink jet recording apparatus described above in conjunction with FIG. 1A through FIG. 8, there is provided a rubbing member 11 in addition to a resilient blade 10, thus making it possible by means of the aforesaid rubbing member 11 to prevent automatically in advance the defective discharging or recording deviation due to the ink films Id in the vicinity of the discharging ports. Also, it becomes possible to prevent the defective discharging or recording deviation efficiently in advance automatically even in such a case that the recording apparatus has not been in use for a long period of time. Further, by controlling the timing of the rubbing operations by the use of a timer, it becomes possible to prevent efficiently the creation of ink films due to the deterioration of the water repellent layer of the discharging port surface 51 by the ink adhering to the vicinity of the discharging ports even in such a case that the recording apparatus is energizing and in use for a long period of time. Furthermore, it is now possible to execute the rubbing operation automatically by detecting the timing of the ink tank (ink cartridge) replacement.

Figure 9:
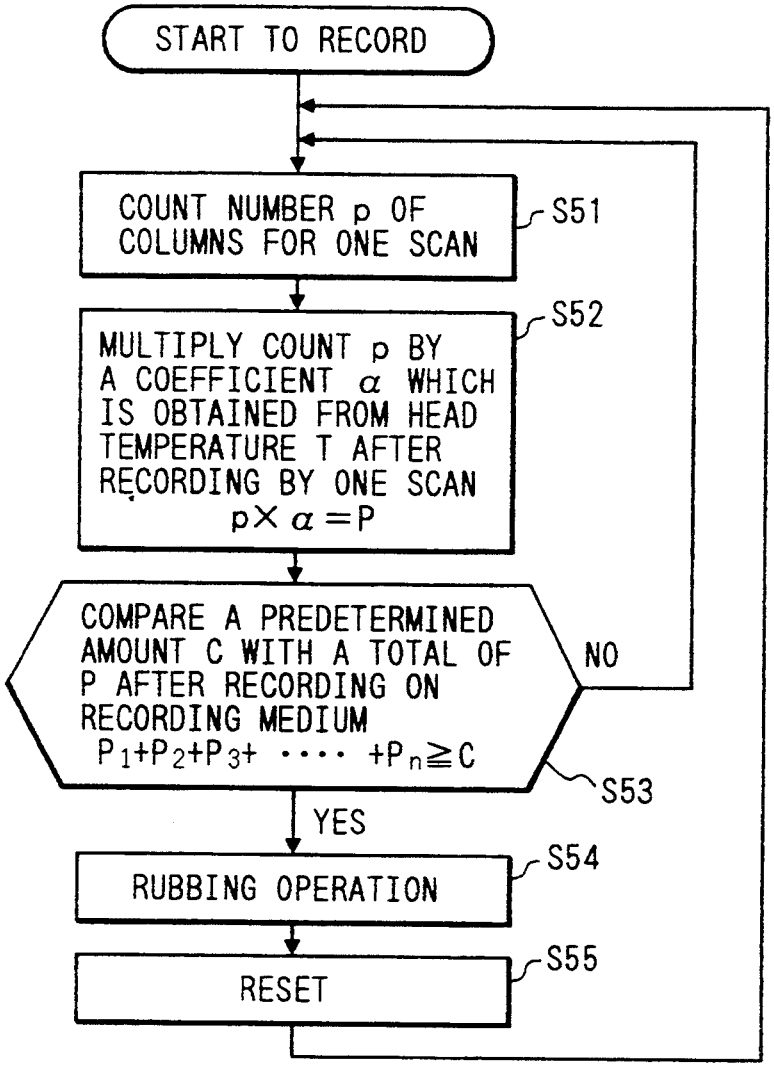
FIG. 9 is a flowchart showing the rubbing operation to be performed in response to the temperatures of the recording head driven for the image formation in an ink jet recording apparatus according to the present invention.

FIG. 9 is a flowchart showing the rubbing operation to be executed in consideration of the temperature of the recording head driven for image formation. The present example is such that the temperature of the recording head is detected for each one scanning to obtain coefficient $\alpha$ for the temperature. Thus, on the basis of the printing column number p and coefficient $\alpha$ for each one scanning, the timing of the rubbing operation is determined. Table 1 shows coefficient $\alpha$ for the temperature of the recording head (temperature at the time of terminating one recording scan).

TABLE 1

| Recording head temperature | Coefficient $\alpha$ |
|---|---|
| 45° C.– | 1.0 |
| 40° C.–45° C. | 1/1.5 |
| –40° C. | 1/2.5 |

In FIG. 9, when recording is started, the printing column number for one scanning of the recording head is first counted in step S51. This counting is given as P. Then, in step S52, a coefficient $\alpha$ is given from those obtainable in the conversion table shown in Table 1 to obtain $p \times \alpha = p$ by multiplying the column number obtained in the step S51. In other words, this coefficient $\alpha$ is obtainable by detecting the temperature indicated when the recording head has terminated one scanning. Then, in step S53, an added value EP of the aforesaid P is compared with a predetermined counting value C for each time the printing for one sheet of the recording medium is completed.

If the EP is smaller than the C, then the recording will be continued. If the $\Sigma p$ is greater than the C, then a rubbing operation is started in step S54. When the rubbing operation is terminated, the counted value $\Sigma P$ is reset in step S55. In this respect, the comparison between the counting value C and $\Sigma P$ may be executed at each time one line printing is terminated. The aforesaid counting value C may be set for 114 columns×80 lines×4 sheets=36,480 columns, for example. This counting value C should be varied depending on the characteristic of ink to be used or the property of material used for the recording head to be employed. In other words, this counting value C should necessarily be determined in consideration of the degree of ink deposition on the discharging port surface due to the printing performed by the recording head to be used. If such a deposition can easily result, it is possible to make the setting column number small. If the deposition cannot result easily, then it is possible to make the setting column number large. Moreover, if an enhanced reliability is desired, it may be possible to set the column number to be smaller.

Figure 10:
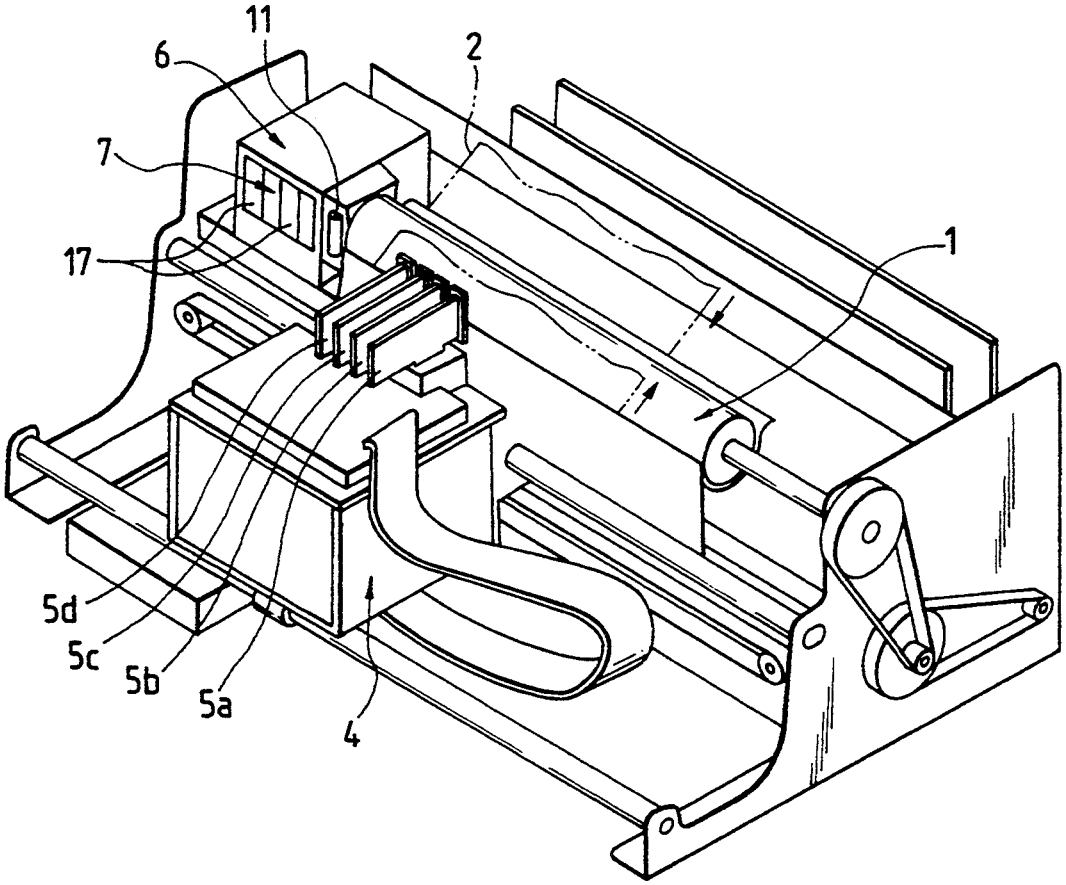
FIG. 10 is a perspective view illustrating the structure of the principal part of an embodiment of an ink jet recording apparatus provided with a plurality of recording means according to the present invention.

FIG. 10 is a perspective view illustrating the principal structure of another embodiment of an ink jet recording apparatus to which the present invention is applicable. In FIG. 10, a plurality of recording means (recording heads) 5*a*, 5*b*, 5*c*, and 5*d* are mounted on a carriage 4 and when a full color recording is required, these recording heads discharge black, cyan, magenta, and yellow ink, respectively, to perform such recording. Outside the recording area (on the left-hand side of the platen 1 in the example shown in FIG. 10), its home position HP is provided at a predetermined location. At this home position HP, there is arranged a discharging recovery device 6 provided with a capping means 7 capable of closing the discharging port surface 51 of the aforesaid recording heads 5*a*, 5*b*, 5*c*, and 5*d* airtightly when the aforesaid carriage 4 has arrived at the home position HP. In this capping means 7, the cap 17 which is structured to cover the discharging port surface 51 of the four recording heads 5*a*, 5*b*, 5*c*, and 5*d* airtightly at one time is provided as shown in FIG. 10. Also, on this discharging recovery device 6, a rubbing member 11 is mounted to be slidably in contact with each of the discharging port surfaces 51 of the four recoridng heads 5*a*, 5*b*, 5*c*, and 5*d*. Here, this rubbing member 11 is also mounted to interlock its advance or retraction with the movement of the capping means 7 as in the case of FIG. 4.

Figure 11:
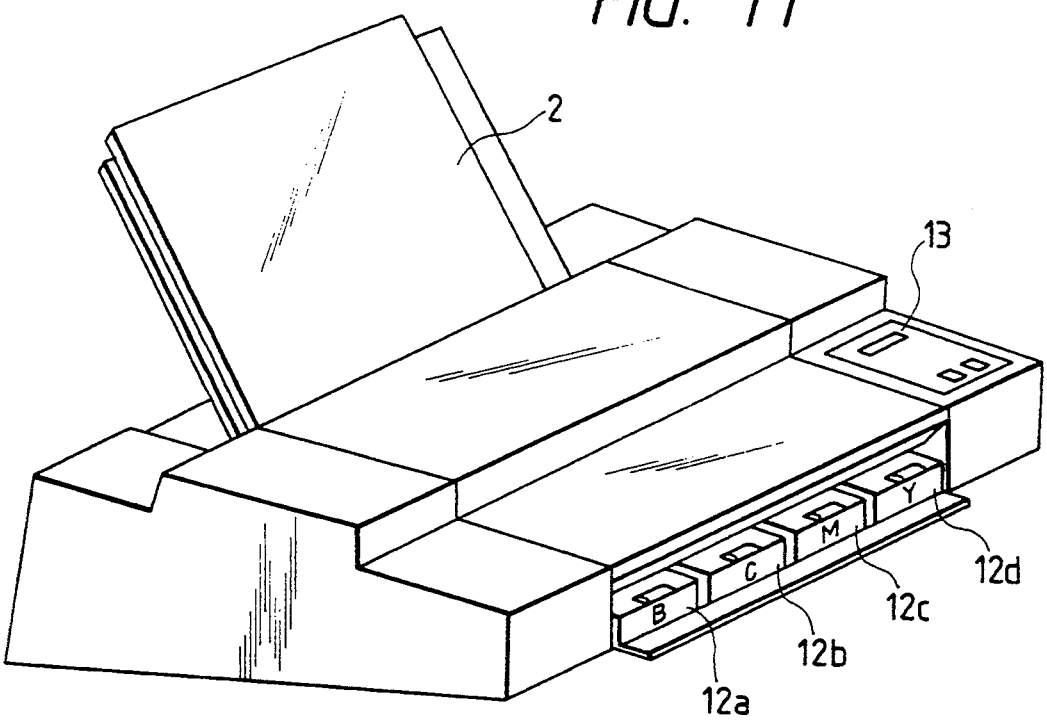
FIG. 11 is a perspective view illustrating the outer appearance of the ink jet recording appartus shown in FIG. 10.

The ink jet recording apparatus shown in FIG. 10 has the four recording heads 5*a*, 5*b*, 5*c*, and 5*d* as described above, for which four pieces or four caps 17 and ink cartridges are provided. This is the only difference from the ink jet recording apparatus shown in FIG. 1, and all the other parts thereof are substantially of the same structure. FIG. 11 is a perspective view illustrating the outer appearance of the recording apparatus shown in FIG. 10. In FIG. 11, four ink cartridges 12*a*, 12*b*, 12*c*, and 12*d* are mounted in the front part of the recording apparatus to supply each of the colored ink corresponding to each of the aforesaid recording heads 5*a*, 5*b*, 5*c*, and 5*d*. Also, in the display panel of the recording apparatus, there are arranged empty displays for the respective colored ink cartridges 12*a*, 12*b*, 12*c*, and 12*d*, that is, the display unit (a liquid crystal display, for example) 13 to indicate that the ink remainder of a particular color has become less than a set amount therefor. In this respect, when all of or one of the aforesaid plurality of recording means (recording heads) 5*a*, 5*b*, 5*c*, and 5*d* and the aforesaid plurality of ink cartridges 12*a*, 12*b*, 12*c*, and 12*d* is indicated arbitrarily in the following description, it is to be understood that these means and cartridges are simply referred to as recording means (recording head) 5 and ink cartridge 12.

Now, in FIG. 10 and FIG. 11, the ink jet recording apparatus having a plurality of recording means, whether or not a specific recording means 5 has been already in a state that the prearranged rubbing operation should be executed is determined for each of the recording means, and the structure is arranged so that the rubbing member 11 is allowed to be slidably in contact with the vicinity of the discharging ports (discharging port surface 51) for each of the specific recording means 5. In this case, the slidable contact ( rubbing operation ) of the rubbing member 11 is performed automatically by a method to interlock with the ink remainder detection for the ink cartridge (ink tank), or by a method to control the temperature of the recording means 5 and actuate on the basis of the number of recording mediums. Control of the rubbing operation such as this is performed by a control system shown in FIG. 5.

Figure 12:
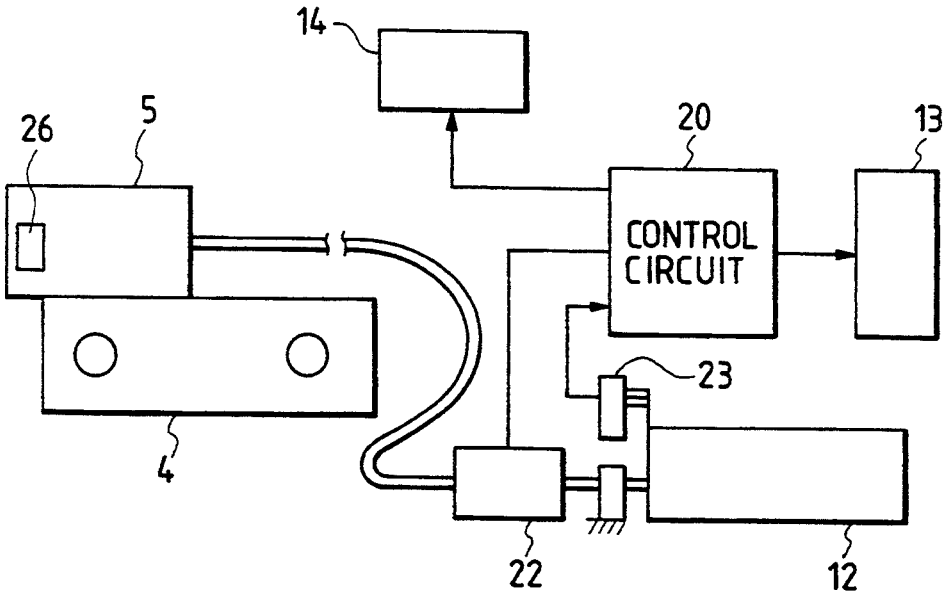
FIG. 12 is a block diagram showing the structure of the principle part of the control system for controlling a first rubbing operation of the ink jet recording apparatus shown in FIG. 10.

FIG. 12 is a block diagram showing the principal structure of the rubbing operation control system of an ink jet recording apparatus described in FIG. 10 and FIG. 11. In FIG. 12, there are provided in each of the ink tanks 12, an ink sensor 22 for detecting the remaining quantity therein and an ink tank sensor 23 for detecting the presence (whether mounted or not) of the aforesaid ink tank 12. For the aforesaid ink sensor 22, a sensor of a pressure detecting type such as a diaphragm may be employed, and the state of the ink consumption detected by the aforesaid ink sensor 22 is displayed by means of the control circuit 20 on the aforesaid display unit 13 (FIG. 11) for each ink tank 12. The ink tank (ink cartridge) 12 displayed on this display unit to indicate its emptiness of ink should be replaced with an ink tank full of ink. Here, when the ink tanks 12 are replaced, the ink cartridge sensor 23 detects this to cause the control circuit 20 to actuate the driving source 14 for a rubbing operation. Then, for the discharging port surface 51 of the corresponding recording means, that is, a specific recording means 5, the rubbing operation is executed. This driving source 14 is constructed by a carriage motor, recovery device driving motor, and others.

Figure 13:
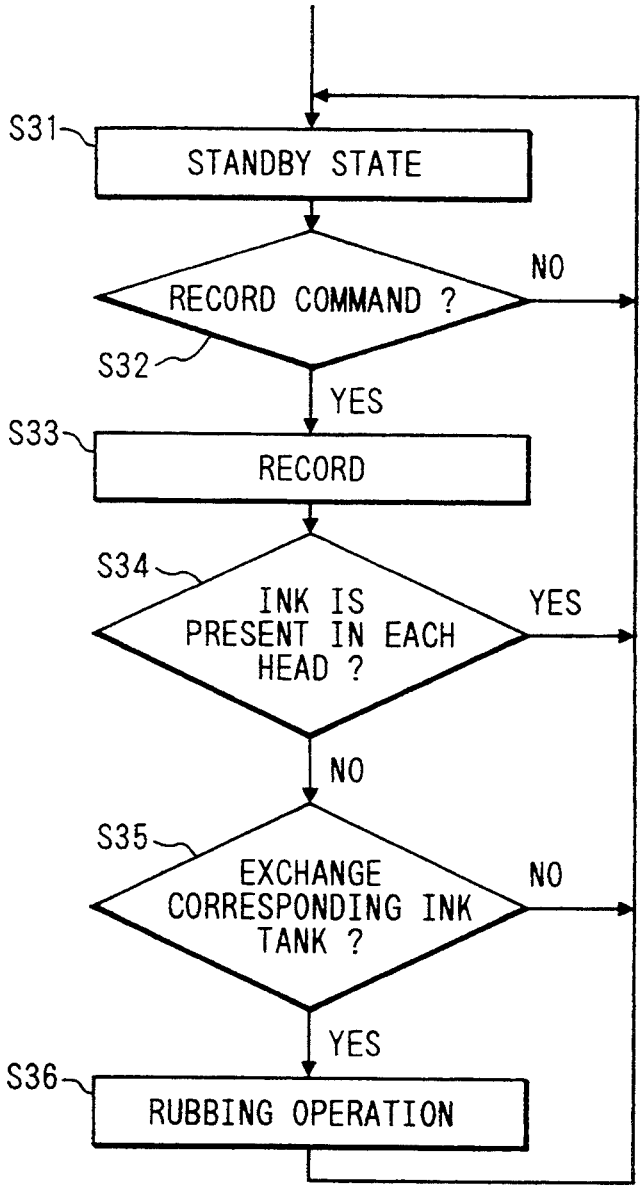
FIG. 13 is a flowchart showing the sequence of the first rubbing operation of the ink jet recording apparatus shown in FIG. 10.

FIG. 13 is a flowchart showing the sequence of the rubbing operation in accordance with the aforesaid ink remainder detection. In FIG. 13, in a standby state in step S31, whether any recording instruction is present in step S32. If any recording instruction is found to be present, the recording is executed in step S33. Then, in step S34, the ink remainder detection is performed for each of the ink tanks 12 (for each color). If the ink remaining is less than a predetermined amount (no ink remains), then the process proceeds to step S35 to examine whether the corresponding (specific) ink tank (ink cartridge) 12 has been replaced or not. If replaced, the rubbing operation for the discharging port surface 51 of the corresponding (specific) recording means 5 is performed in step S36. In this respect, if no recording instruction is present and ink still remains, then the process will return to be in the usual standby state.

In an ink jet recording apparatus provided with a plurality of recording heads 5 for coloring, each recording head 5 is arbitrarily driven for discharging. As a result, there are some cases where a particular recording head 5 has a high duty, and the creation of the ink films Id in the circumference of the discharging ports 52 is irregular. The recording head which is exceedingly driven is apt to have high temperatures. Thus, the frequency of creation of the ink films Id becomes high. Therefore, by the use of the head temperature detecting means 26 (FIG. 5 and FIG. 12) such as a thermistor, the temperature of each recording head 5 is detected according to the present invention, and when the recording is performed at a temperature higher than a predetermined temperature for more than a predetermined number of recording mediums, a rubbing operation is given to the discharging port surface 51 of the corresponding recording heads 5 in order to prevent its defective discharging in advance.

Figure 14:
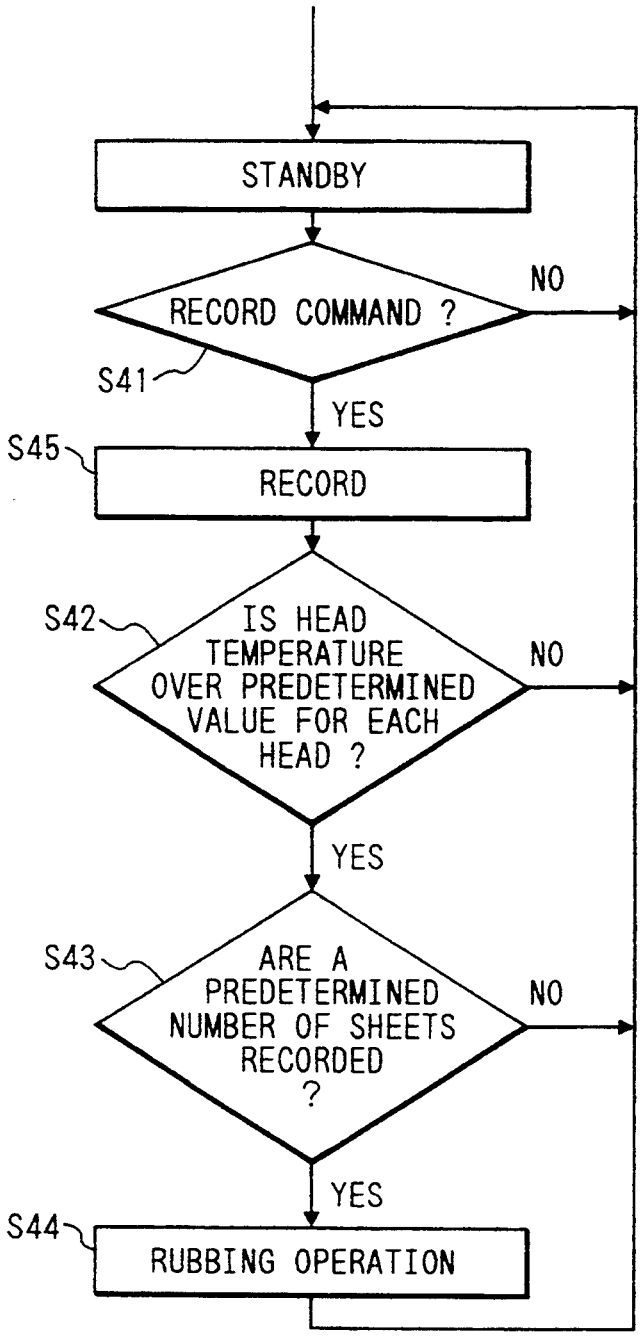
FIG. 14 is a flowchart showing the sequence of the second rubbing operation of the ink jet recording apparatus shown in FIG. 10.

FIG. 14 is a flowchart showing the sequence of the rubbing operation control for each recording head on the basis of the temperature of each of the aforesaid recording heads 5. In FIG. 14, the presence of recording instruction is examined in step S41. If any recording instruction is present, the recording is performed in step S45. Then, in step S42, whether the temperature of each of the recording heads 5 is above a predetermined temperature or not is determined. If above the predetermined temperature, the process proceeds to step S43 to examine whether the recording has reached a predetermined sheet number of the recording medium or not. If the temperature of the recording head 5 is higher than a predetermined temperature and the recording has been performed for more than a predetermined number of sheets, a rubbing operation is performed by means of the control circuit 20 for the corresponding head 5, that is, such a specific recording head 5. Here, if the recording head 5 has not reached a predetermined temperature or the recording has not reached a predetermined sheet number, then the process will return to be in the usual standby state.

In FIG. 10, for the rubbing operation for each of the recording means (recording heads), that is, the rubbing operation for each of the ink colors for a color recording, the carriage 4 is driven by a carriage motor such as a pulse motor to drive a specific (corresponding) recording head 5 to the position facing the rubbing member 11 for its setting. Then, the aforesaid rubbing member 11 is advanced to be in contact with the discharging port surface 51. Subsequently, the carriage 4 is driven for a predetermined amount (may be driven reciprocally) for the execution of the rubbing operation. When the rubbing operation is terminated, the rubbing member 11 is retracted. Then, a preliminary discharging or usual recovery operation is performed. According to an ink jet apparatus described above in conjunction with FIG. 10 through FIG. 14, it is possible for a recording apparatus provided with a plurality of recording means (recording heads) 5 for a color recording to perform an automatic rubbing operation efficiently for a specific recording head 5, to execute a cleaning process for the stabilized ink discharging in advance with good timing, and also to reduce the frequency of the rubbing operations as well as to shorten the time required for each rubbing operation. Thus, it is further possible to obtain an ink jet recording apparatus capable of implementing a longer life of the rubbing member.

Here, in each of the above-mentioned embodiments, while the description has been made of the case where one or plural recording means (recording heads) 5 are mounted on the carriage 4, the present invention is equally applicable to a line type ink jet recording apparatus and the like using the line recording means which corresponds partially or totally to the entire recording area in the width direction of a recording medium irrespective of the kinds of scanning methods, and the same effects can be obtained thereby. Also, in the above-mentioned embodiment, while the description has been made of an example in which a color ink jet recording apparatus for performing the recording in different colors as an ink jet recording apparatus having a plurality of recording heads, the present invention is equally applicable to an ink jet recording apparatus for tonal recording use and the like using a plurality of recording means for the same color but different densities irrespective of the number of the recording means, and the same functional effects can be obtained thereby.

Also, for the recording means (recording head) in the above-mentioned embodiments, it is possible to use an exchangeable cartridge type recording means having the recording head integrally with the ink tank, or a recording means which is constructed with the separate recording head and ink tank which are connected by a coupler and tubes, for example, or some others of various constructions.

In this respect, while the present invention is applicable to an ink jet recording apparatus having the recording means (recording head) using an electromechanical transducer or the like such as piezoelectric elements, it is particularly capable of demonstrating excellent effects when applied to an ink jet recording apparatus of a type in which ink is discharged by utilizing thermal energy because with such a type, it is possible to achieve highly precise and superfine recordings.

For the typical structure and principle thereof, it is preferable to adopt for its implementation the fundamental principle disclosed, for example, in the specifications of U.S. Pat. No. 4,723,129 and U.S. Pat. No. 4,740,796. This method is applicable to either so-called on demand type and continuance type. Particularly, in the case of the on demand type, at least one driving signal, which gives a recording liquid (ink) a rapid temperature rise exceeding the nuclear boiling, is applied in response to the recording information provided for the electrothermal converting elements arranged with respect to a sheet or liquid pass holding a recording liquid (ink) thereby causing the electrothermal converting elements to generate thermal energy. Hence, film boiling is generated on the thermoactive plane of the recording means (recording head), resulting efficiently in the formation of a bubble in the recording liquid one to one in response to this driving signal.

The recording liquid (ink) is discharged through the discharging ports by the growth and contraction of this bubble to form at least one droplet. It is more preferable to produce this driving signal in the form of pulses. Then the growth and contraction of the bubble is appropriately performed instantaneously to implement the discharging of recording liquid (ink) with particularly excellent responsivity. For this pulse type driving signal, the one such as disclosed in the specifications of U.S. Pat. No. 4,463,359 and U.S. Pat. No. 4,345,262 is suitable. In this respect, if the condition disclosed in the specification of U.S. Pat. No. 4,313,124 for the invention which deals with the ratio of temperature rise on the above-mentioned thermoactive plane, it is possible to perform an excellent recording in a better condition.

As the structure of the recording head, the present invention includes a combination of the discharging port, liquid pass, electrothermal converting elements (linear liquid pass or rectangular liquid pass) such as disclosed in each of the above-mentioned specifications as well as the structure having the thermoactive portion arranged in the bending region using the configuration disclosed in the specifications of U.S. Pat. No. 4,558,333 and U.S. Pat. No. 4,459,600. In addition, the present invention is effective with the structure respectively on the basis of the structure having a common slit as a discharging unit for electrothermal converting elements with respect to a plurality of electrothermal converting elements as disclosed in Japanese Patent Laid-Open Application No. 59-123670 or the structure having the opening for absorbing the pressurized waves of thermal energy, which is arranged with respect to the discharging port as disclosed in Japanese Patent Laid-Open Application No. 59-138461. In other words, this is because, according to the present invention, a recording can be performed reliably and efficiently irrespective of the modes of the recording head to be adopted.

Furthermore, to the full-line type recording head having a length corresponding to the maximum width of the recording medium on which the recording apparatus can perform its recording, the present invention is effectively applicable. For such a recording head, there may be a structure to attain the required length by combining a plurality of recording heads or a structure to attain such a length by a single recording head which is integrally constructed itself. In addition, the present invention is effectively applicable to the serial type recording apparatus exemplified above, the recording head fixed to the main body of the apparatus, or a freely exchangeable chip type recording head for which electrical connections and ink supply from the main body of the apparatus are possible by installing the recording head in the main body thereof, or a cartridge type recording head having the ink tank integrally provided for the recording head itself.

Also, it is preferable to add a recovery means, preliminarily auxiliary means, and the like provided for the recording head as constituents of a recording apparatus according to the present invention because with these constituents, the effect of the present invention becomes more stable. To mention specifically, these constituents are a capping means for the recording head, cleaning means, compression or suction means, electrothermal converting elements or thermal elements independent thereof or preliminary heating means provided by the combination thereof. It is also effective to provide a preliminary discharging mode which performs preliminary discharging aside from the discharging for the regular recording.

Also, for the kind and number of the recording heads to be mounted, it may be possible to provide only one head for a single ink color, for example, or a plurality of heads for different recording colors or densities of ink. In other words, as a recording mode of the recording apparatus, the present invention is extremely effective in a recording apparatus which is provided with the recording head formed integrally or by a combination of a plurality of heads for recoloring with different colors or at least one for full-color by mixing colors besides a recording mode for one major color such as black.

In the embodiments of the present invention set forth above, the description has been made of the ink which is a liquid, it may be possible to use ink which is solidified at room temperature or less, or liquified when the signal for recording use is given because in the ink jet method a temperature control is generally practiced so that the ink viscousity is kept within a range of stable discharging by adjusting the temperature of the ink itself in a range from 30° C. or more to 70° C. or less. Furthermore, the present invention is suitably applicable to the use of the ink which is liquified only by thermal energy or any other types of ink which can be liquified by the thermal energy generated in response to the recording signals for the liquid ink discharging, or the ink which begins to be solidified just before reaching the recording medium while preventing any temperature rise due to the thermal energy by way of its positive energy application to changing the state of ink from the solid to liquid or using the ink which is solidified for the prevention of its evaporation if it is left intact.

The ink to be used in a case such as this may be maintained in a mode where it is held in the concavities of a porous sheet or through holes in a solid or liquid state for the electrothermal converting elements as disclosed in Japanese Patent Laid-Open Application No. 54-56847 or Japanese Patent Laid-Open Application No. 60-71260. In the present invention, the most effective method among those applicable to each of the above-mentioned types of ink is the one which implements the aforesaid film boiling method.

Furthermore, as the mode of the ink jet recording apparatus to which the present invention is applicable, there may be those used for copying machines in combination with readers, and facsimile apparatuses having a transmitter and a receiver, or the like in addition to the image output terminals for a computer or other information processing apparatuses.

As is clear from the above description, in an ink jet recording apparatus for performing recording by discharging ink from the recording means to a recording medium according to the present invention, the structure is made so that a rubbing member is slidably in contact with the vicinity of the discharging ports of the recording means for each of the predetermined operations. It is therefore possible to remove ink droplets, water droplets, dust and other impurities adhering to the vicinity of the discharging ports and at the same time, to remove the ink films due to the adhering ink. As a result, it is possible to prevent in advance the strength required for peeling the ink films which cause the defective discharging from becoming great, thus enabling the provision of an ink jet recording apparatus thereby to implement the stabilized ink discharging without any attention of the user. Also, the timing of the rubbing operations is regulated for the slidable rubbing in consideration of the recording head temperature and the tendency for an easier ink adhesion in other to achieve a more reliable cleaning (recovery) operation thus making it possible to provide an ink jet recording apparatus capable of attaining a higher printing quality.

Also, in an ink recording apparatus for performing recording by discharging ink from a plurality of recording heads according to another invention hereof, the structure is made so that a rubbing member is slidably in contact with the vicinity of the discharging ports of a specific recording means. Therefore, it is possible to remove the films due to the ink droplets and water droplets adhering to the vicinity of the discharging ports of each specific recording means even when the apparatus is provided with plural recording means as well as to prevent in advance the strength required for peeling the ink films which cause the defective discharging from becoming great for each specific recording means. Thus, the stabilized discharging of each of the recording means is efficiently implemented without any attention of the user. It is further possible to provide an ink jet recording apparatus capable of preventing the frequency of the rubbing operations from increasing, which may otherwise take place due to the arrangement of the plural recording heads.

What is claimed is:

1. An ink jet apparatus comprising:

recording means having an ink jet head for discharging ink from a discharge surface to record on a recording medium;

a rubbing member with a rubbing surface for engaging in surface-to-surface contact with and thereby rubbing said discharge port surface;

detecting means for detecting an exchange of said recording means; and control means for causing said rubbing member to rub said discharge surface in accordance with the detection by said detecting means of an exchange of said recording means.

2. An ink jet apparatus for use with recording means having an ink jet head for discharging ink from a discharge surface to record on a recording medium, said apparatus comprising:

a rubbing member with a rubbing surface for engaging in surface-to-surface contact with and thereby rubbing said discharge port surface;

timer means for measuring a period between when power to said apparatus was turned off and when power to said apparatus is turned back on;

comparing means for comparing with a set time the period measured by said timer means; and control means for causing said rubbing member to rub said discharge surface if said comparing means detects that the period measured by said timer means exceeds the set time.

3. An ink jet apparatus comprising:

recording means having an ink let head for discharging ink from a discharge surface to record on recording medium;

a rubbing member with a rubbing surface for engaging in surface-to-surface contact with and thereby rubbing said discharge port surface;

detecting means for detecting a temperature of said ink jet head;

means for formulating a coefficient $\alpha$ in accordance with the temperature detected by said detecting means;

means for counting a number p of columns recorded by said recording means;

comparing means for comparing with a set value a value obtained from the coefficient $\alpha$ and the number p; and control means for causing said rubbing member to rub said discharge surface if said comparing means detects that the value obtained from the coefficient $\alpha$ and the number p exceeds the set value.

4. An ink jet apparatus according to claim 1, 2 or 3, wherein said rubbing member is formed with a porous material, a fibrous tissue or a nonwoven fabric.

5. An ink jet apparatus according to claim 1, 2 or 3 wherein said recording means is an ink jet recording means provided with electrothermal converting for generating thermal energy for ink discharging.

6. An ink jet apparatus according to claim 5, wherein said ink jet recording means causes ink to be discharged from the discharging ports by boiling in ink by the thermal energy generated by said electrothermal converting elements.

7. An ink jet recording apparatus comprising:

a plurality of recording means for recording in color on a recording medium by discharging different color ink from a discharge surface of respective recording means;

a rubbing member with a rubbing surface for selectively engaging in surface-to-surface contact with and thereby rubbing said discharge port surfaces;

detecting means for detecting a temperature of each of said recording means;

comparing means for comparing with a set temperature the temperature detected by said detecting means;

discriminating means for discriminating when a number of recording mediums recorded by said recording means reaches a predetermined number; and control means for causing said rubbing member to rub said discharge surface only of said recording means with a temperature higher than the set temperature as detected by said comparing means and when said discriminating means discriminates that the number of recording mediums recorded by said recording means has reached the predetermined number.

8. An ink jet recording apparatus according to claim 7, wherein said recording means is an ink jet recording means provided with electrothermal converting elements for generating thermal energy for ink discharging.

9. An ink jet recording apparatus according to claim 8, wherein said ink jet recording means causes ink to be discharged from the discharging ports by boiling ink by the thermal energy generated by said electrothermal converting elements.

10. An ink jet apparatus according to claim 1, wherein said detecting means detects ink remaining in said recording means and determines that said recording means has been exchanged by detecting the absence of ink.

11. An ink jet apparatus according to claim 3, wherein said comparing means makes comparison after one recording medium is recorded.

12. An ink jet apparatus according to claim 3, wherein said comparing means makes a comparison after one line is recorded.

13. An ink jet recording apparatus according to claim 7, wherein said rubbing member is formed with a porous material, a fibrous tissue or a nonwoven fabric.

* * * * *

UNITED STATES PATENT AND TRADEMARK OFFICE

CERTIFICATE OF CORRECTION

PATENT NO. : 5,398,054

DATED : March 14, 1995

INVENTORS : HIDEO FUKAZAWA ET AL.

It is certified that error appears in the above-identified patent and that said Letters Patent is hereby corrected as shown below:

ON THE TITLE PAGE

At [57] "ABSTRACT"

Line 2, "recorder" should read --recorder to--.

COLUMN 1

Line 11, "computer or," should read --computer,--.
Line 43, "defectives" should read --defects--.
Line 54, "viscousity" should read --viscosity--.

COLUMN 8

Line 45, "rest" should read --reset--.

COLUMN 9

Line 21, "energizing" should read --energized--.
Line 50, "p x α = p" should read --p x α = P--.
Line 58, "EP" should read --ΣP--.

COLUMN 10

Line 34, "recoridng" should read --recording--.

COLUMN 14

Line 60, "viscousity" should read --viscosity--.

UNITED STATES PATENT AND TRADEMARK OFFICE

CERTIFICATE OF CORRECTION

PATENT NO. : 5,398,054

DATED : March 14, 1995

INVENTORS : HIDEO FUKAZAWA ET AL.

It is certified that error appears in the above-identified patent and that said Letters Patent is hereby corrected as shown below:

COLUMN 15

Line 43, "other" should read --order--.

COLUMN 16

Line 30, "let" should read --jet--.
Line 31, "on" should read --on a--.
Line 53, "or 3" should read --or 3,--.
Line 56, "converting" should read --converting elements--.
Line 61, "in" should be deleted.

COLUMN 18

Line 16, "makes" should read --makes a--.

Signed and Sealed this

Twenty-seventh Day of June, 1995

Bruce Lehman

*Attest:*

BRUCE LEHMAN

*Attesting Officer*

*Commissioner of Patents and Trademarks*